US010420427B2

(12) United States Patent
Hachmann

(10) Patent No.: US 10,420,427 B2
(45) Date of Patent: Sep. 24, 2019

(54) GOODS HOLDER HAVING TWO SIGNAL-PRODUCING MEANS

(71) Applicant: INVENTORY SYSTEMS GMBH, Berlin (DE)

(72) Inventor: Georg Hachmann, Berlin (DE)

(73) Assignee: INVENTORY SYSTEMS GMBH, Berlin (DE)

( * ) Notice: Subject to any disclaimer, the term of this patent is extended or adjusted under 35 U.S.C. 154(b) by 108 days.

(21) Appl. No.: 15/532,069

(22) PCT Filed: Nov. 9, 2015

(86) PCT No.: PCT/EP2015/076059
§ 371 (c)(1),
(2) Date: May 31, 2017

(87) PCT Pub. No.: WO2016/087161
PCT Pub. Date: Jun. 9, 2016

(65) Prior Publication Data

US 2017/0265654 A1 Sep. 21, 2017

(30) Foreign Application Priority Data

Dec. 5, 2014 (DE) ..... 10 2014 225 067

(51) Int. Cl.
*A47F 5/08* (2006.01)
*A47F 5/00* (2006.01)
(Continued)

(52) U.S. Cl.
CPC ..... *A47F 5/0861* (2013.01); *A47F 5/0006* (2013.01); *A47F 7/0007* (2013.01); *G08B 13/12* (2013.01); *G08B 13/14* (2013.01)

(58) Field of Classification Search
CPC ..... A47F 5/0861; A47F 5/0006; A47F 7/0007
See application file for complete search history.

(56) References Cited

U.S. PATENT DOCUMENTS 3,785,501 A * 1/1974 Canning ..... A47F 5/0861 211/57.1
3,827,569 A * 8/1974 Canning ..... A47F 5/0861 211/7

(Continued)

FOREIGN PATENT DOCUMENTS

CH 681952 A5 * 6/1993 ..... A47F 5/0861
CN 101236681 A 8/2008

(Continued)

OTHER PUBLICATIONS

CN Office Action dated May 21, 2019 as received in Application No. 201580066160.9.

*Primary Examiner* — Stanton L Krycinski
(74) *Attorney, Agent, or Firm* — Maschoff Brennan

(57) ABSTRACT

A goods holder, on which a plurality of goods can be arranged one behind the other in a movable manner, in such a way that a front good of a row of goods arranged one behind the other can be moved in the direction of a front end of the goods holder and can be removed from the goods holder at said front end. The goods holder having at least one displaceably supported signal-producing means, which can be displaced as a result of a movement of a frontmost good in the direction of the front end and triggers the production of a removal signal in the event of a displacement in order to indicate a removal of the good from the good holder. Two displaceably supported signal-producing means are provided on the goods holder.

14 Claims, 5 Drawing Sheets

(51) Int. Cl.

| | |
|---|---|
| ***A47F 7/00*** | (2006.01) |
| ***G08B 13/14*** | (2006.01) |
| ***G08B 13/12*** | (2006.01) |

(56) References Cited

U.S. PATENT DOCUMENTS

| | | | | |
|---|---|---|---|---|
| 5,597,150 | A * | 1/1997 | Stein | A47F 5/0861 211/57.1 |
| 5,711,432 | A | 1/1998 | Stein et al. | |
| 7,392,673 | B2 * | 7/2008 | Fawcett | A47F 5/0861 211/7 |
| 7,484,628 | B2 * | 2/2009 | Schneider | A47F 5/0861 211/47 |
| 7,768,399 | B2 | 8/2010 | Hachmann et al. | |
| 8,534,469 | B2 * | 9/2013 | Northrup, Jr. | A47F 5/0861 211/57.1 |
| 8,602,224 | B2 * | 12/2013 | Casey | A47F 5/0861 211/57.1 |
| 8,629,772 | B2 * | 1/2014 | Valiulis | G08B 13/149 340/568.8 |
| 8,739,981 | B2 * | 6/2014 | Piskor | A47F 5/0861 211/59.1 |
| 9,167,916 | B2 * | 10/2015 | Grant | A47F 5/0861 |
| 9,318,008 | B2 * | 4/2016 | Valiulis | G08B 13/149 |
| 9,386,864 | B2 * | 7/2016 | Pongrac | A47F 5/0861 |
| 9,468,315 | B2 * | 10/2016 | Ha | A47F 5/0861 |
| 2004/0026344 | A1 * | 2/2004 | Sedon | A47F 5/0861 211/7 |
| 2009/0057244 | A1 * | 3/2009 | Conti | A47F 5/0861 211/7 |
| 2009/0095695 | A1 | 4/2009 | Moock et al. | |
| 2011/0038695 | A1 | 2/2011 | Vosshenrich | |
| 2013/0141240 | A1 | 6/2013 | Valiulis et al. | |
| 2014/0070948 | A1 | 3/2014 | Valiulis et al. | |
| 2014/0352372 | A1 * | 12/2014 | Grant | A47F 5/0861 70/57.1 |
| 2015/0216325 | A1 * | 8/2015 | Pongrac | A47F 5/0861 211/59.3 |

FOREIGN PATENT DOCUMENTS

| | | | | |
|---|---|---|---|---|
| CN | 202150173 | U | 2/2012 | |
| CN | 102497797 | A | 6/2012 | |
| DE | 20 2005 013979 | U1 | 12/2005 | |
| FR | 2581304 | A1 * | 11/1986 | A47F 5/0861 |
| WO | 2006/061009 | A1 | 6/2006 | |
| WO | WO-2006061009 | A1 * | 6/2006 | A47F 5/0861 |
| WO | 2010/094778 | A1 | 8/2010 | |
| WO | 2011/035371 | A1 | 3/2011 | |

* cited by examiner

GOODS HOLDER HAVING TWO SIGNAL-PRODUCING MEANS

CROSS-REFERENCE TO A RELATED APPLICATION

This application is a National Phase Patent Application of International Patent Application Number PCT/EP2015/076059, filed on Nov. 9, 2015, which claims priority of German Patent Application Number 10 2014 225 067.6, filed on Dec. 5, 2014.

BACKGROUND

The invention relates to a goods holder.

A goods holder, for example in the form of a rack hook, permits the arrangement of several goods arranged movably one behind the other, for example in a retail business, in order to present the goods in an attractive manner and to keep them ready for a customer to remove easily. The individual goods are movably arranged on the goods holder, for example hung thereon, wherein a front good of a row of goods arranged one behind the other is movable in the direction of a front end of the goods holder and can be removed from the goods holder at this front end of the latter.

For theft prevention and for stock monitoring, it is already known to provide such goods holders with electronics, via which a removal of a good from the goods holder is detectable. For example, a displaceably mounted signal-producing means can be provided in a goods holder, which means is displaceable when a frontmost good is displaced in the direction of the front end and, during a displacement, triggers the production of a removal signal, via which a removal of the goods is then displayed by the goods holder. Such a signal-producing means can be implemented, for example, in the form of a pivotably mounted swinging arm. Via such a swinging arm, it is also possible to achieve the situation where only ever a single good but not several goods can be removed simultaneously from the goods holder. Such a solution is known, for example from WO 2006/061009 A1.

With such a goods holder, it is for example easily possible to draw conclusions about an atypical removal pattern and therefore a potential attempt at theft, by using removal signals that are produced. With regard to stock or level monitoring, however, it is regularly disadvantageous that a statement about the current level, i.e. the goods kept ready on the goods holder, is not possible merely on the basis of the removal signals. For example, a removal signal is also produced when a good previously removed by a customer is arranged on the goods holder again or is topped up by the staff. If such a goods holder is also set up to acknowledge each removal of a good acoustically by means of a swinging arm, the return of a good by a customer or the filling of the goods holder with new goods by the sales staff also produces acoustic feedback. This is likewise felt to be disadvantageous.

In a goods holder known from WO 2010/094778 A1, in order to solve this problem it is proposed to monitor the displacement movement of a goods feed, by means of which goods arranged on the goods holder are urged in the direction of a front end of the goods holder. Here, via contacts provided on a circuit board, in the event of a displacement of the feed, sequences of displacement signals that are distinguishable from one another are produced, depending on whether the goods feed is displaced in the direction of the front end or in the displacement direction opposite thereto. Although this solution is extremely effective and expedient, it always assumes the use of a feed unit and is therefore not suitable for all applications with regard to size and costs.

SUMMARY

The invention is therefore based on the object of overcoming the aforementioned disadvantages and of providing a goods holder which is improved from this point of view, without having to use a feed unit.

This object is achieved by a goods holder with features as described herein.

Here, a goods holder according to the invention has two displaceably mounted signal-producing means which, in the event of a movement of a frontmost good in the direction of the front end, are displaced one after the other so that as a result—preferably successively—at least two removal signals are triggered.

As a result of the production of different removal signals by two signal-producing means which, in the event of a movement of a frontmost good in the direction of the front end of the goods holder, needed for the removal, are displaced one after the other, it is in particular possible to distinguish the removal of a good from the return of a good and from topping up the goods holder. Thus, for example, during removal of a good, a first signal-producing means is displaced first and then a second signal-producing means. By contrast, during the return of a good, the second signal-producing means is displaced first and then the first signal-producing means.

In an exemplary embodiment, the signal-producing means are pivotably mounted on the goods holder, for example about a common pivot axis or about two separate pivot axes. Here, a pivot axis can be defined, for example, by a circularly cylindrical mounting element of the goods holder, on which the signal-producing means are each pivotably mounted. Such a mounting element is provided, for example in the form of a cylindrical pin on the goods holder.

In an exemplary embodiment, the signal-producing means each have a control section, past which a good must be led as its moved in the direction of the front end and on which the good to be moved acts hereby, so that a displacement movement is forced on the signal-producing means by the good led past. Thus, for example in a design variant for a rack hook, provision is made that a good held and movably arranged thereon must be moved past convexly curved control sections of the signal-producing means to be removed, so that the good pulled in the direction of the front end moves and/or pivots the signal-producing means as a result of the action on the curved control sections. The associated displacement of the signal-producing means is detected electronically and in each case triggers a removal signal.

In a development, the goods holder with its signal-producing means is formed in such a way that the good to be removed, as it is moved in the direction of the front end, acts with a region on the respective control section on which the good is held on the goods holder, preferably suspended.

In an exemplary embodiment, the control sections of the signal-producing means are offset in relation to each other along a removal direction, along which a frontmost good to be removed is moved to the front end of the goods holder. The control sections are thus located one after another with respect to the removal direction, so that the good to be removed acts on the latter with a time offset when the good is moved toward the front.

Alternatively or additionally, the signal-producing means can be arranged beside each other transversely with respect to a removal direction. The signal-producing means can thus be provided in a space-saving manner on the goods holder. In a design variant, the signal-producing means are formed in such a way that these are arranged beside one another but the control sections thereof are located one after another with reference to the removal direction. For example, for this purpose two swinging arms of different sizes are provided as signal-producing means, or two identically formed swinging arms are provided beside each other but offset somewhat in relation to each other in the removal direction.

To trigger a removal signal during displacement of a signal-producing means, the goods holder has at least two reed contacts, by means of which two removal signals can be produced during the displacement of the signal-producing means. For example, the signal-producing means can each have a reed contact or a magnet interacting with a reed contact.

In a design variant, the goods holder is additionally equipped with a separating mechanism, which ensures the goods can be removed only singly from the goods holder. For the function of the separating mechanism, it is primarily critical that simultaneous movement of several goods toward the front end of the goods holder is hereby prevented. Via the separating mechanism, however, it is possible to prevent a further, following good also from being moved as far as the front end of the goods holder, as long as a frontmost good has not yet been removed from the goods holder. Since only ever individual goods can be removed from the goods holder one after another, the risk of thefts of greater quantities of goods is considerably reduced, since it is not possible for several goods to be moved simultaneously toward the front end and removed from the goods holder.

In an exemplary embodiment, at least one signal-producing means is also part of such a separating mechanism. Thus, the signal-producing means can be displaceable by a frontmost good moved in the direction of the front end of the goods holder from a release position to a blocking position, wherein the signal-producing means in the blocking position then prevents a new movement of a good arranged behind the frontmost good in the direction of the front end. In its blocking position, the signal-producing means consequently blocks the new movement and therefore also the simultaneous movement of several goods in the direction of the front end of the goods holder. In a variant, the signal-producing means has a blocking section for this purpose, which, in the blocking position, projects in such a way that a good cannot be moved over the blocking section toward the front end of the goods holder. Here, the signal-producing means in its blocking position projects into a displacement path of the goods and, for example, projects at right angles to the removal direction, so that goods cannot be moved over the latter in the direction of the front end. Thus, for example, goods are usually movably suspended on a goods holder by an opening provided in a goods package. In the blocking position, the signal-producing means with its blocking section projects so far at right angles to the removal direction that the projection of the blocking section exceeds the height of the opening in the goods package, and thus movement past the blocking section is not possible without destruction of the goods package.

In a design variant based thereon, a signal-producing means in its release position projects with a convexly curved control section on an underside of a goods holder while, in the blocking position, a blocking section of the signal-producing means projects on an upper side of the goods holder. If a good is moved forward along the control section toward the front end of the goods holder, the good urges the signal-producing means in the direction of the upper side of the goods holder. By means of a movable or pivotable mounting of the signal-producing means, the blocking section is hereby urged (more intensely) out of the upper side of the goods holder, so that the blocking section prevents any further good from being moved in the direction of the front end as long as the frontmost good is acting on the control section of the signal-producing means and has not yet been removed from the goods holder.

In an exemplary embodiment, at least two signal-producing means are provided, which are each displaceable between a release position and a blocking position. Thus at least two signal-producing means are part of a separating mechanism. Since at least two signal-producing means that are each displaceable into a blocking position are provided, ultimately there are at least two mechanical obstacles which prevent simultaneous removal of several goods from the goods holder.

In principle, it is preferred for the signal-producing means to permit both movement and removal of a good and filling of the goods holder with additional goods and/or pushing a good back within the context of a return. Accordingly, for example a signal-producing means which is part of a separating mechanism is also formed and displaceably mounted on the goods holder in such a way that, during the filling of the goods holder and/or a return of a good, a good can be moved over the signal-producing means in the direction of a rear end of the goods holder.

Furthermore, an electronic evaluation unit is preferably provided, by means of which, by using the triggered removal signals, it is possible to evaluate the direction in which a good has been moved. Such an electronic evaluation unit is preferably integrated in the goods holder. Consequently, the goods holder with the evaluation unit and an output device coupled thereto for the output of an acoustically and/or visually perceptible goods removal signal, e.g. with a loudspeaker, a light and/or display, can form an autonomous structural unit, which is functional without further cabling and in this way can simply be mounted on a (rack) wall. Of course, an electronic evaluation unit can also alternatively or additionally be arranged separately from a holding section of the goods holder on which the goods are movably held. Then, for example, an interface for a connecting cable to the evaluation unit can be provided on the holding section, or such a connecting cable can be integrated, in order to transmit the removal signals to the evaluation unit.

Here, the evaluation unit is preferably set up to produce an acoustically and/or visually perceptible goods removal signal if, by using the received removal signals, it has been detected that goods have been removed from the goods holder. If, on the other hand, on the basis of the removal signals received from the evaluation unit, it is established that goods have been displaced past the two signal-producing means in the direction of the rear end, no goods removal signal is produced. In this way, a removal sound, which indicates the removal of a good from the goods holder acoustically and/or visually, is also actually produced only in the event of the removal of a good.

Consequently, in this variant, the removal signals from the signal-producing means are assessable by the evaluation unit but the removal signals cannot be perceived visually and/or acoustically. Whether ultimately a different and/or acoustically perceptible goods removal signal is produced for this purpose, ultimately depends on the sequence of the removal signal that is produced and consequently on an assessment of the evaluation unit, which produces such a goods removal signal only when goods have actually been moved in the direction of the front end and removed from the goods holder.

BRIEF DESCRIPTION OF THE DRAWINGS

Further advantages and features of the invention can be gathered from the exemplary embodiments explained below by using the appended figures.

DETAILED DESCRIPTION

Figure 1A:
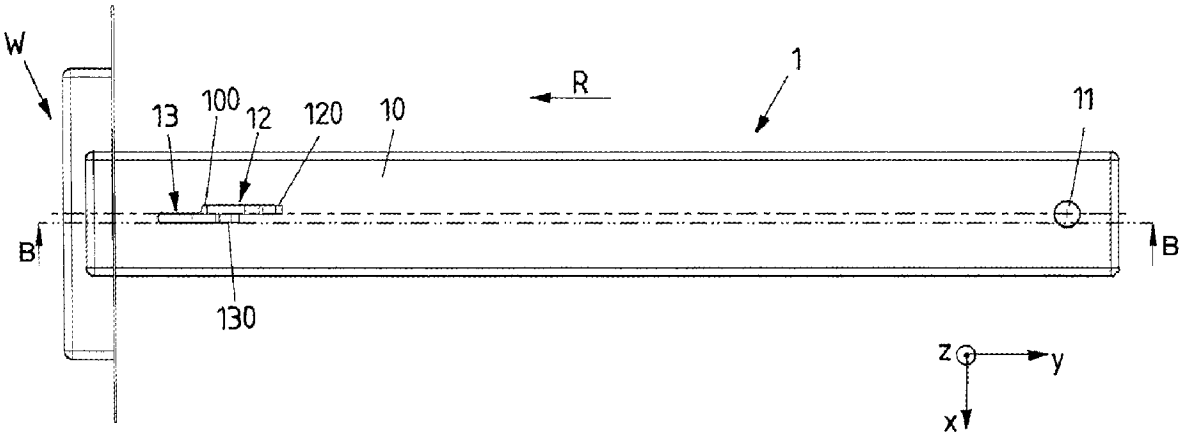
FIGS. 1A-1D show, in different views, an exemplary embodiment of a goods holder according to the invention having two pivotably mounted swinging arms as signal-producing means.
Figure 1B:
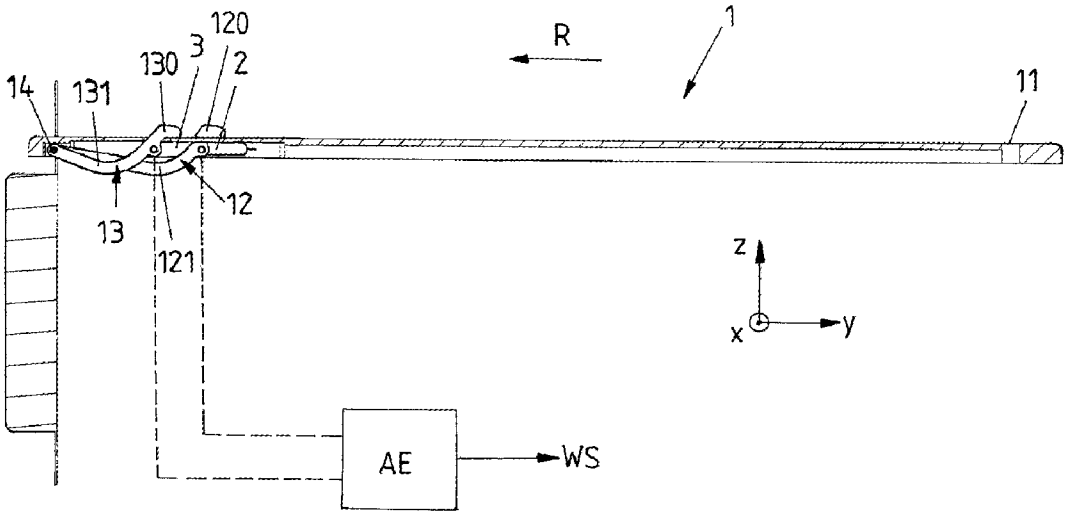
Figure 1C:
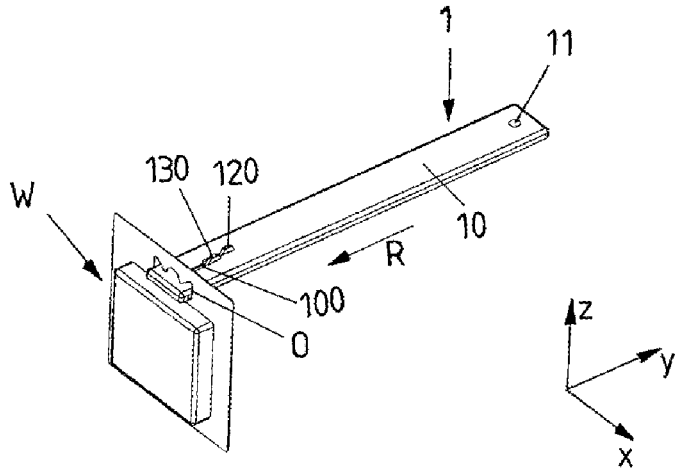
Figure 1D:
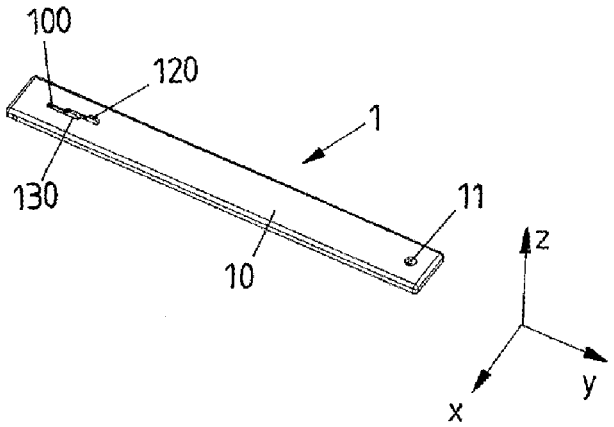
Figure 2A:
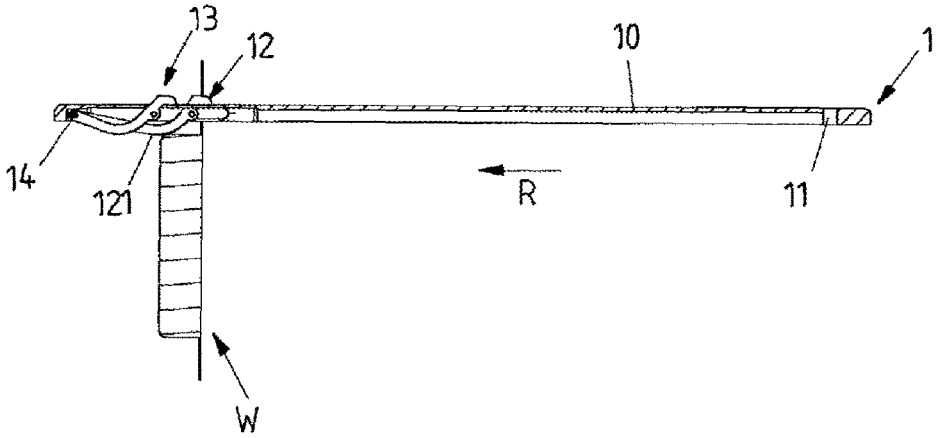
FIGS. 2A-2E show different phases of a removal of a frontmost good from the goods holder from FIGS. 1A-1D and the displacement movements of the two swinging arms that result here.
Figure 2B:
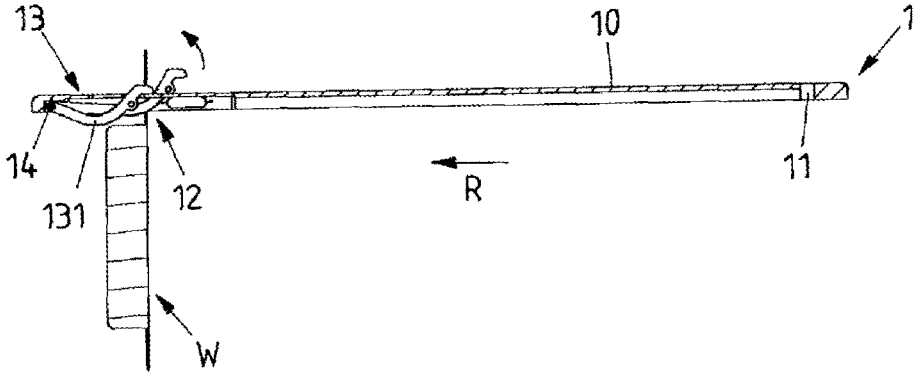
Figure 2C:
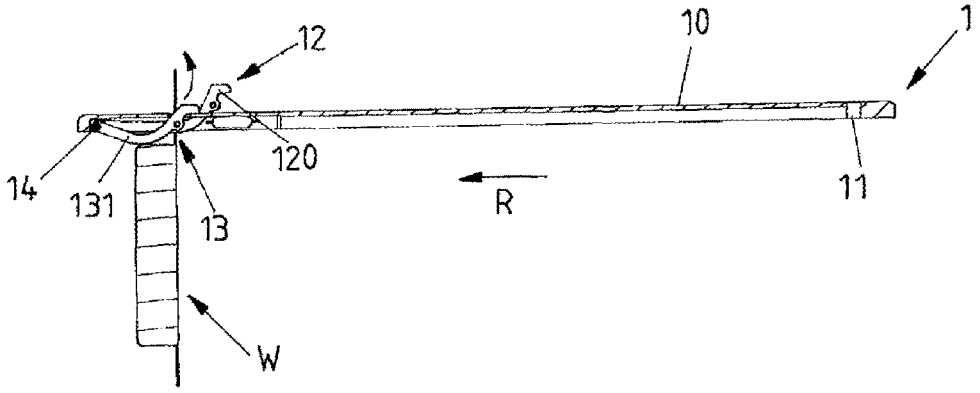
Figure 2D:
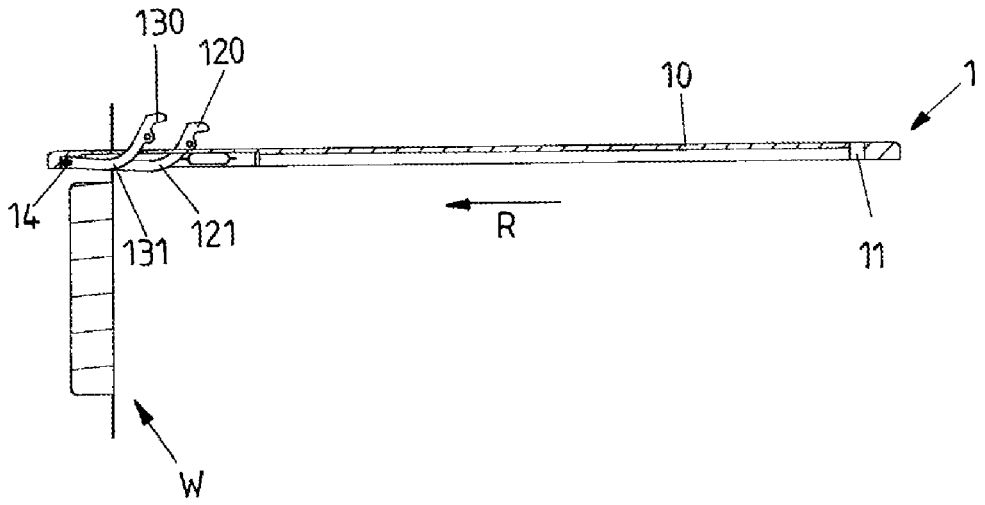
Figure 2E:
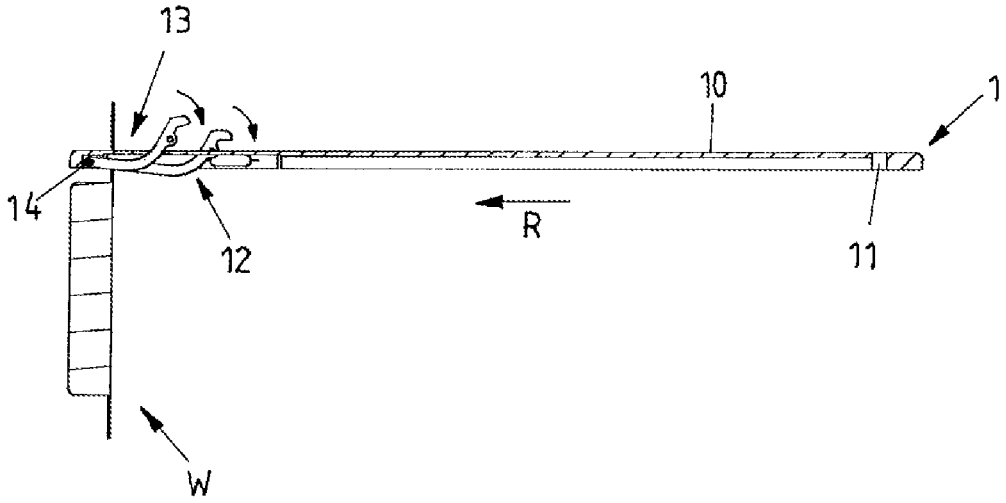

FIGS. 1A to 1D show in different views a goods holder 1 in the form of a rack hook. The goods holder 1 has an elongated, here rod-like, holding section 10, on which goods can be arranged movably one behind the other. Here, the individual goods are pushed onto the goods holder 1 over a front end of the goods holder 1. For this purpose, each good carries on its goods package an appropriate dimensioned opening O, through which the holding section 10 can reach.

At its rear end, the goods holder 1 is to be fixed as intended to a (rack) wall via a fixing point 11 of the holding section 10. At the opposite front end of the goods holder 1, the goods can be removed, in that they are moved forward along a removal direction R. In order to detect the removal of a good W from the goods holder 1 electronically here and then to produce a removal sound only when a good W has actually been removed at the front end, the goods holder 1 is provided with two signal-producing means in the form of two swinging arms 12 and 13 in the region of its front end. These two swinging arms 12 and 13 are both pivotably mounted about a common pivot axis 14 on the holding section 10. In addition, the two swinging arms 12 and 13 are formed and arranged such that both swinging arms 12 and 13 are pivoted one after the other in a pivoting direction when a good W is led along the holding section 10 past the swinging arms 12 and 13 in the removal direction R, so that it can be removed at the front end of the goods holder 1.

The two swinging arms 12 and 13, which here are pivotably mounted about a mounting element, for example in the form of a cylindrical pin, defining the pivot axis 14, each project in the release position illustrated in FIGS. 1 A to 1D with a bulbous, convexly curved control section 121 or 131 on an underside of the goods holder 1. The projection of the two control sections 121 and 131 is chosen here such that a frontmost good W to be removed acts on these control sections 121 and 131 one after the other during a movement in the removal direction R and, in this way, pivots both swinging arms 12 and 13 one after the other in the same pivoting direction about their pivot axis 14. Thus, the two swinging arms 12 and 13 have different lengths and, as a result, the two control sections 121 and 131 are offset in relation to each other in the removal direction R. So, the first swinging arm 12 is about 25% longer than the second swinging arm 13. In this way, a good W moved in the direction of the front end of the goods holder 1 firstly makes contact with the control section 121 of the first swinging arm 12 and pivots the same in the direction of the front end—in the counterclockwise direction—about the pivot axis 14. If the good W is moved further in the direction of the front end, it makes contact with the control section 131 of the second, shorter swinging arm 13 and likewise, as a result of sliding along on the control section 131, pivots said swinging arm in the counterclockwise direction about the pivot axis 14, as illustrated in FIGS. 2A to 2E.

The two swinging arms 12 and 13 cooperate respectively with a reed contact 2, 3, in order to produce a removal signal during a displacement. For this purpose, a reed contact or reed sensor 2, 3 is respectively provided on the holding section 10. The respective reed contact 2 or 3 is switched when the associated swinging arm 12 or 13 is pivoted out of a release position, shown in FIGS. 1A to 1D, by a good W moved forward. A signal from the reed contact 2 or 3 indicating the pivoting of a swinging arm 12 or 13 is transmitted as a removal signal to an electronic evaluation unit AE. The evaluation unit AE is preferably integrated on the goods holder 1 and accommodated in or on the holding section 10, so that the goods holder 1 with the evaluation unit AE forms an autonomous structural unit, which is serviceable without further cabling and can simply be mounted on a (rack) wall.

By using the sequence of removal signals generated, the evaluation unit AE can assess whether a good W has actually been moved in the direction of the front end of the goods holder 1 and, for example, a good has not been moved in the direction of the rear end, for example when filling the goods holder 1. Thus, during a removal of the good W, the first swinging arm 12 is pivoted first and then the second swinging arm 13, whereas during an insertion of a good W in the direction of the rear end, the two swinging arms 12 and 13 are pivoted in the opposite order. If, by using the removal signals produced by the reed contacts 2 and 3 by the displacement of the swinging arms 12 and 13, the evaluation unit AE detects the fact that a good W has been moved past the two swinging arms 12 and 13 in the direction of the front end of the goods holder 1, the evaluation unit AE produces a goods removal signal WS. A removal of a good W is acknowledged acoustically via this goods removal signal WS. Alternatively or additionally, the goods removal signal WS can be visually perceptible. An output device coupled to the evaluation unit AE to output an acoustically and/or visually perceptible goods removal signal WS, for example having a loudspeaker, a light and/or a display, is preferably likewise integrated on the goods holder 1.

The two swinging arms 12 and 13 in the present case are also part of a separating mechanism of the goods holder 1, via which it is possible to prevent several goods W from being removed simultaneously from the goods holder 1. Via this separating mechanism, it is ensured that only ever a single good W can reach the front end of the goods holder 1 and can be removed there as intended. The two swinging arms 12 and 13 have blocking sections 120 and 130 for this purpose, via which an individual good W can be displaced in the removal direction R when the two swinging arms 12 and 13 are in their release position. The blocking sections 120 and 130 are likewise arranged one behind the other along the removal direction R and project on an upper side of the holding section. However, as a result of the goods W sliding along on the control sections 121 and 131 of the swinging arms 12 and 13, the latter are pivoted, as already explained above. As a result of this pivoting, however, the respective associated blocking sections 120 and 130 then project on the upper side of the holding section 10, so that movement of a further good over the blocking sections 120 or 130 is not possible. Only after the frontmost good W has been removed as intended at the front end of the goods holder 1 can the swinging arms 12 and 13 pivot back into their release position again and the displacement path is released again.

The control sections 121 and 131 of the two swinging arms 12 and 13 project on an underside of the holding section 10, so that a good W to be moved urges the blocking sections 120 and 130 more intensely upward. In order that a blocking section 120 or 130 and an associated control section 121 or 131 of a swinging arm 2 or 3 can project on different sides of the holding section 1, the holding section 10 has a passage opening 100 for the two swinging arms 12 and 13 if the holding section 10, as in the present case, is equipped with a preferably flat top surface.

In order that the two swinging arms 12 and 13 remain in a blocking position, in which a new movement of a further good in the direction of the front end of the goods holder 1 is prevented until a good W moved to the front end is removed from the goods holder 1, the pivot axis 14 of the two swinging arms 12 and 13 is arranged close to the front end of the goods holder 1. Furthermore, the curvature of the swinging arms 12 and 13 is chosen appropriately, so that a good W in the region of the front end of the goods holder 1 and therefore in the region of the pivot axis 14 still acts on the control sections 121 and 131 of the two swinging arms 12 and 13. In this way, the swinging arms 12 and 13 cannot assume their release position again until the good W has been removed from the goods holder 1.

Although the two swinging arms 12 and 13 also permit a return of a good W and an associated movement of a good on the goods holder 1 counter to the removal direction R and a removal signal is produced hereby via the reed contacts 2 and 3, the electronic evaluation unit AE ensures that, in such case, no goods removal signal WS is produced. Said unit evaluates a series of removal signals produced and generates a goods removal signal WS that is perceptible by a customer and the sales staff only in the case of a movement of a good W in the direction of the front end of the goods holder 1 over the swinging arms 12 and 13. The goods holder 1 this acknowledges only an actual goods removal with an acoustically and/or visually perceptible goods removal signal, but not every return of a good W or filling of the goods holder with goods.

In a departure from the illustration in FIGS. 1A to 1D and 2A to 2E, a design variant is provided to mount two swinging arms offset relative to each other in the removal direction R on different, mutually parallel pivot axes. Here, each swinging arm is consequently pivotable about its own pivot axis. In this way, the two swinging arms of a goods holder 1 can be formed as identical parts. Given appropriate physical proximity of the pivot axis, provision can also be made here for a good W located at the front end of the goods holder 1 to keep both swinging arms in the blocking position until the good W has been removed from the goods holder 1. However, this is not mandatory. In a variant having two pivot axes for the two swinging arms, provision can thus also be made for only one swinging arm—the front one with respect to the removal direction R—to be kept in its blocking position via the good W located at the front end of the goods holder 1.

Figure 3A:
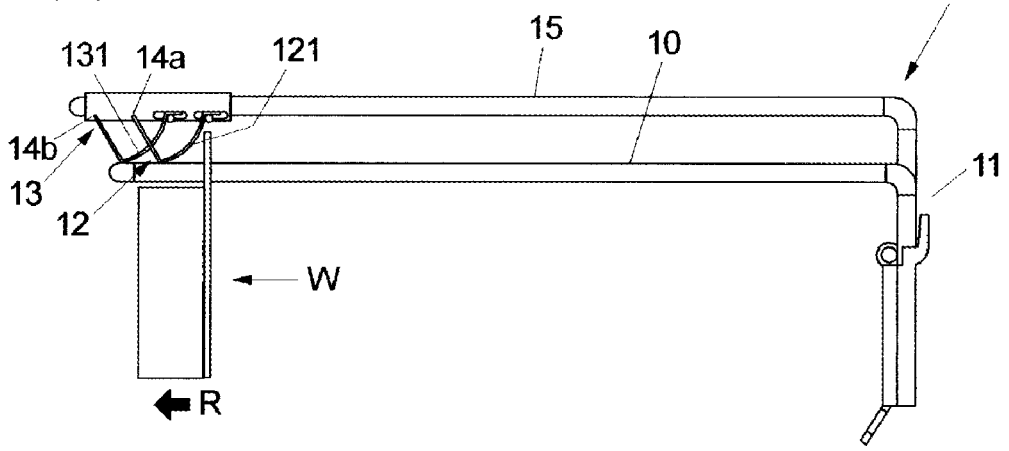
FIGS. 3A-3C show a further exemplary embodiment of a goods holder according to the invention in different phases during the removal of a frontmost good and with the displacement movements that result here of two pivotably mounted swinging arms as signal-producing means.
Figure 3B:
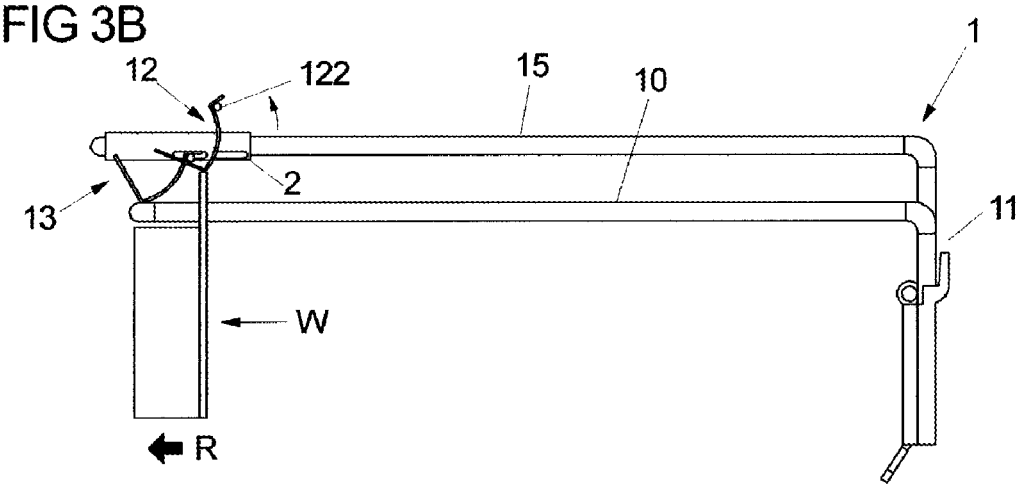
Figure 3C:
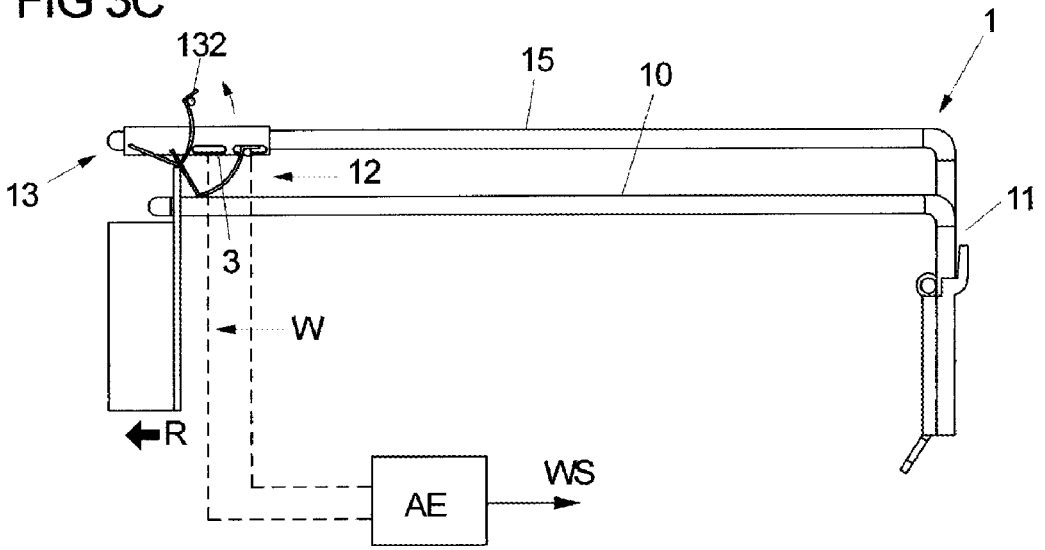

FIGS. 3A, 3B and 3C show in different views a further design variant of a goods holder 1 in the form of a rack hook. The goods holder 1 here, in addition to an elongated, here rod-like, holding section 10, has a storage section 15 extending parallel thereto. The longitudinally extended storage section 15 arranged above the holding section 10 here carries the signal-producing means that can be pivoted respectively about their own pivot axis 14*a* or 14*b* in the form of two swinging arms 12 and 13. The swinging arms 12 and 13 are also formed and arranged in this design variant such that both swinging arms 12 and 13 are pivoted one after the other in a pivoting direction when a good W is led along the holder section 10 in the removal direction R past the swinging arms 12 and 13.

The control sections 121 and 131 of the two swinging arms 12 and 13 here project from the storage section 15 in the direction of the holding section 10. In this way, a good W moved in the direction of the frontmost removal position in the region of the holding section 10 necessarily comes into contact successively with the control sections 121 and 131 and pivots the swinging arms 12 and 13 upward about their pivot axes 14*a* and 14*b*.

To produce the removal signals, in each case a magnet element 122 or 132 is provided at a free end of a swinging arm 12 or 13. This magnet element 122 or 132 cooperates with a stationary reed contact 2 or 3 on the storage section 15. Consequently, if a swinging arm 12 or 13 is pivoted by the good W led past the same and, as a result, the respective magnet element 122 or 132 is spaced apart from the associated reed contact 2 or 3, the production of an electronically further evaluable removal signal and/or a visually and/or acoustically perceptible removal signal is associated herewith. The magnet elements 122 and 132 are formed as permanent magnets, for example, for this purpose.

The storage section 15, which is arranged above the holding section 10 provided to hold the good W, can of course have cross-sectional shapes different from the cross-sectional shape of the holding section 10. Furthermore, the storage section 15 can, for example, be equipped to hold a label at its front end. Moreover, the storage section 15 can be designed for the arrangement and accommodation of an evaluation unit AE. For this purpose, the storage section 15, for example, if appropriate only in a sub region, forms a section configured in the manner of a housing, in which not only the reed contacts 2 and 3 but also the electronic evaluation unit AE or at least parts thereof are accommodated in a protective manner. Such an appropriately housing-like configured structure of the storage section 15 defines a cavity within the storage section 15, for example, in which the aforementioned components can be accommodated and fixed. Such a cavity can then be closed with a cover, for example, which is removable for repair or maintenance purposes, for example in order to change a battery provided for the autonomous operation of the evaluation unit (AE).

In an analogous way, in the design variants of FIGS. 1A to 1D and 2A to 2E, the holding section 10 provided here can be formed for the arrangement and accommodation at least of parts of the evaluation unit AE. For this purpose, the holding section 10 forms, for example, possibly only in a sub region, a section configured in the manner of a housing, in which the reed contacts 2 and 3 and/or the electronic evaluation unit AE or at least parts thereof are accommodated in a protective manner. Such an appropriately housing-like configured structure of the holding section 10 then also defines here, for example, a cavity within the holding section 10, in which the aforementioned components can be accommodated and fixed. Such a cavity can then be provided at a rear end of the holding section 10 with reference to the removal direction R and likewise be closed with a cover, for example, which is removable for repair or maintenance purposes.

LIST OF DESIGNATIONS

1 Goods holder
10 Holding section
100 Passage opening
11 Fixing point
12 1st swinging arm (1st signal-producing means)
120 Blocking section
121 Control section
122 Magnet element
13 2nd swinging arm (2nd signal-producing means)
130 Blocking section
131 Control section
132 Magnet element
14, 14*a*, 14*b* Pivot axis
15 Storage section
2, 3 Reed contact
AE Evaluation unit
Opening
R Removal direction
W Good
WS Goods removal signal

The invention claimed is:

1. A goods holder for holding a plurality of goods arranged one behind the other in a movable manner, in such a way that a frontmost good of a row of goods arranged one behind the other at the goods holder can be moved in the direction of a front end of the goods holder and can be removed from the goods holder at said front end, wherein the goods holder has two signal-producing means, each being configured to be displaced as a result of a movement of the frontmost good in the direction of the front end and to trigger the production of a removal signal in the event of a displacement of the signal-producing means in order to indicate a removal of the frontmost good from the goods holder, wherein the two displaceable signal-producing means are configured to be displaced in succession in the event of a movement of the frontmost good in the direction of the front end, so that at least two removal signals are produced as a result, and wherein the goods holder comprises an electronic evaluation unit configured to evaluate the direction in which the frontmost good has been moved based on the at least two removal signals.

2. The goods holder as claimed in claim 1, wherein the two signal-producing means are pivotably supported on the goods holder.

3. The goods holder as claimed in claim 2, wherein the two signal-producing means are pivotable about a common pivot axis or each about its own pivot axis.

4. The goods holder as claimed in claim 1, wherein the two signal-producing means each have a control section, past which a good must be led as the good is moved in the direction of the front end and on which the good to be moved acts hereby, so that a displacement movement is forced on the two signal-producing means by the good led past.

5. The goods holder as claimed in claim 4, wherein the control sections of the two signal-producing means are offset in relation to each other along a removal direction, along which a frontmost good to be removed is moved to the front end of the goods holder.

6. The goods holder as claimed in claim 1, wherein the two signal-producing means are arranged beside each other transversely with respect to a removal direction, along which a frontmost good to be removed is moved to the front end of the goods holder.

7. The goods holder as claimed in claim 1, wherein at least two reed contacts are provided, by means of which two removal signals can be produced in the event of a displacement of the signal-producing means.

8. The goods holder as claimed in claim 7, wherein the two signal-producing means each have a magnet cooperating with one of the at least two reed contacts, or the two signal-producing means each have one of the at least two reed contacts.

9. The goods holder as claimed in claim 1, wherein at least one of the two signal-producing means is displaceable by a frontmost good moved in the direction of the front end of the goods holder from a release position into a blocking position, wherein the signal-producing means in the blocking position prevents a new movement of a good arranged behind the frontmost good in the direction of the front end.

10. The goods holder as claimed in claim 9, wherein the one signal-producing means of the two signal-producing means has a blocking section which, in the blocking position, projects in such a way that a good cannot be moved over the blocking section toward the front end of the goods holder.

11. The goods holder as claimed in claim 9, wherein the one signal-producing means of the two signal-producing means is formed and arranged in such a way that the one signal-producing means is kept in the blocking position by a good moved toward the front end of the goods holder until the good is removed from the goods holder.

12. The goods holder as claimed in claim 9, wherein each one of the two signal-producing means can be displaced between a release position and a blocking position.

13. The goods holder as claimed in claim 1, wherein the two signal-producing means permit both a removal of a good moved toward a front end of the goods holder and filling of the goods holder with goods and/or pushing a good back.

14. The goods holder as claimed in claim 1, wherein the electronic evaluation unit is configured to output, in a manner dependent on the removal signals, an acoustically and/or visually perceptible goods removal signal when a good has been moved in the direction of the front end of the goods holder and the two signal-producing means are displaced hereby.

* * * * *